US006684668B1

(12) United States Patent
Hsueh Lee

(10) Patent No.: US 6,684,668 B1
(45) Date of Patent: Feb. 3, 2004

(54) PROTECTION CASE FOR COMBINATION LOCKS

(75) Inventor: Hsiu Chen Hsueh Lee, Ping-Tung (TW)

(73) Assignee: Federal Lock Co., Ltd., Ping-Tung (TW)

( * ) Notice: Subject to any disclaimer, the term of this patent is extended or adjusted under 35 U.S.C. 154(b) by 0 days.

(21) Appl. No.: 10/408,439

(22) Filed: Apr. 8, 2003

(51) Int. Cl.[7] ..... E05B 67/38

(52) U.S. Cl. ..... 70/56; 70/52; 70/312; 70/417

(58) Field of Search ..... 70/51, 52, 54–56, 70/25, 417, DIG. 43, DIG. 56, 312, 284, 285

(56) References Cited

U.S. PATENT DOCUMENTS 3,835,675 A * 9/1974 Lippisch ..... 70/38 A
4,134,280 A * 1/1979 Pelavin ..... 70/55
4,286,445 A * 9/1981 Sills ..... 70/55
4,576,022 A * 3/1986 Gamble ..... 70/55
4,776,187 A * 10/1988 Evans et al. ..... 70/38 A
4,869,082 A * 9/1989 Appelbaum ..... 70/63
5,156,029 A * 10/1992 Heald ..... 70/55
5,987,940 A * 6/1993 Elsfelder et al. ..... 70/38 A
5,704,231 A * 1/1998 Heald ..... 70/54
5,219,384 A * 11/1999 Chang ..... 70/18
6,164,096 A * 12/2000 Lai ..... 70/25
6,439,008 B1 * 8/2002 Keil ..... 70/56
6,467,316 B1 * 10/2002 Chen ..... 70/56

* cited by examiner

*Primary Examiner*—Lloyd A. Gall
(74) *Attorney, Agent, or Firm*—Rosenberg, Klein & Lee

(57) ABSTRACT

A protection case includes a first part having an open top so as to receive the body of the lock therein and an aperture is defined through a wall of the first part and located in alignment with the key hole of the lock. An opening is defined through a bottom of the first part so as to enclose the digit rings of the lock. A second part is securely mounted on the top of the body and includes a first hole through which the shackle of the lock extends, and a second hole which is located in alignment with the locking hole.

3 Claims, 5 Drawing Sheets

PROTECTION CASE FOR COMBINATION LOCKS

FIELD OF THE INVENTION

The present invention relates to a protection case in which a combination lock is received therein and the case reduces the lock from the risk of being damaged by foreign force.

BACKGROUND OF THE INVENTION

A conventional lock includes a body and a shackle. The shackle is unlocked by inserting a correct key in a key hole in the body. In other words, if the key is lost or illegally copied, anyone who has the key can unlock the lock. A combination lock does not need a key and generally includes a body with a plurality of rings rotatably connected thereto and each ring has digits molded thereon. The user has to set a correct combination of the digits to open the lock. However, the combination lock is easily to be opened by re-set the rings by force. Both of the locks can be damaged and unlocked by hitting the body of the lock.

The present invention intends to provide a protection case for a combination lock which is received in the case and only the key hole and the rings with digits can be accessed.

SUMMARY OF THE INVENTION

In accordance with one aspect of the present invention, there is provided a protection case for locks and the case has a first part for receiving the body of the lock therein and an aperture is defined through a wall of the first part and located in alignment with the key hole of the lock. An opening is defined through a bottom of the first part so as to enclose the rings of the lock.

A second part is securely mounted on the top of the body and includes a first hole through which the shackle extends, and a second hole which is located in alignment with the locking hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
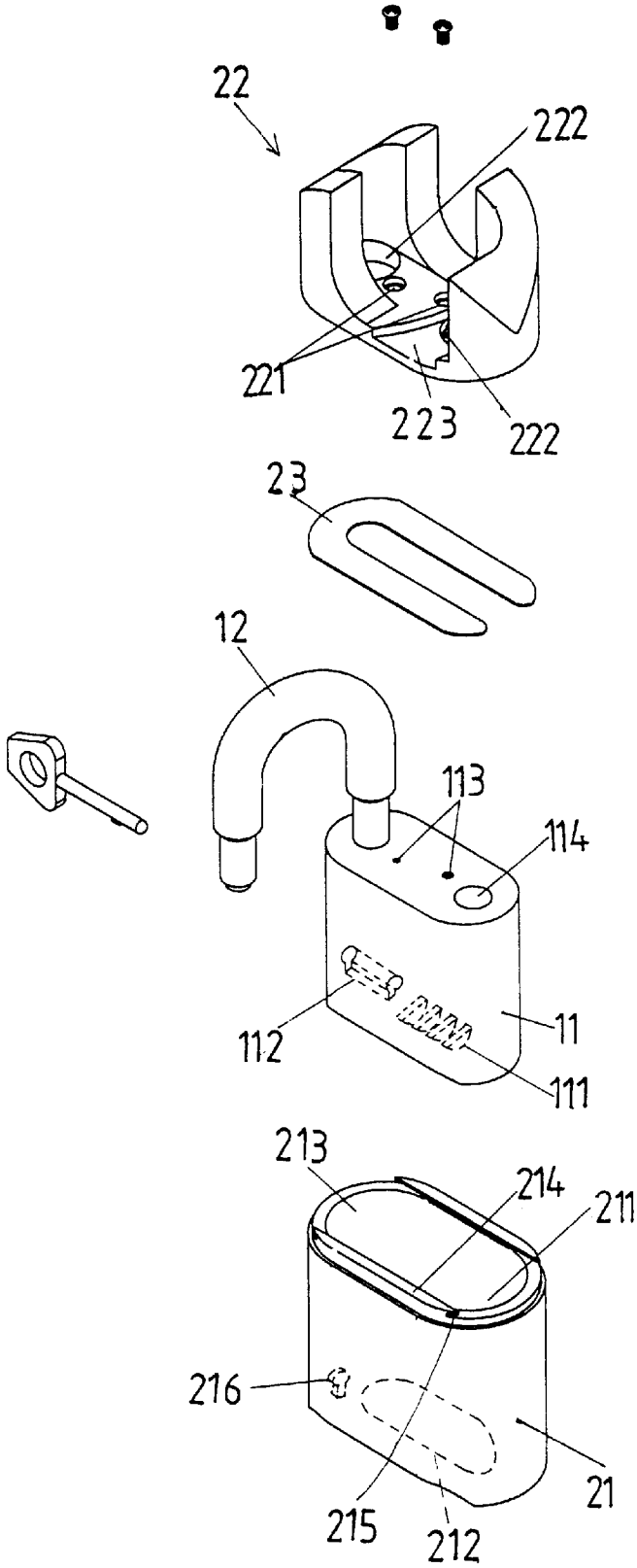
FIG. 1 is an exploded view to show the protection case and the lock.
Figure 2:
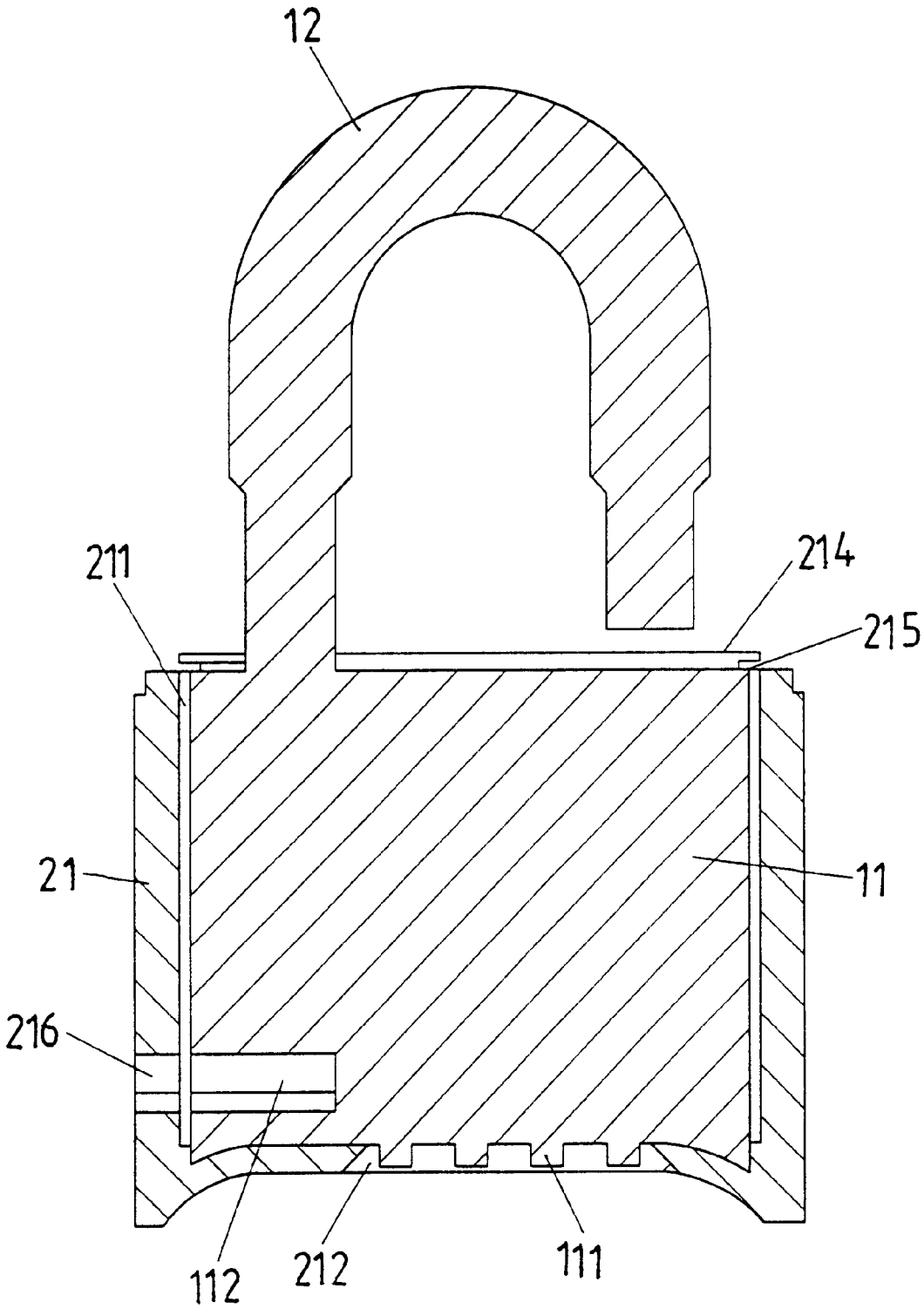
FIG. 2 is a cross sectional view to show the lock is received in the protection case.
Figure 3:
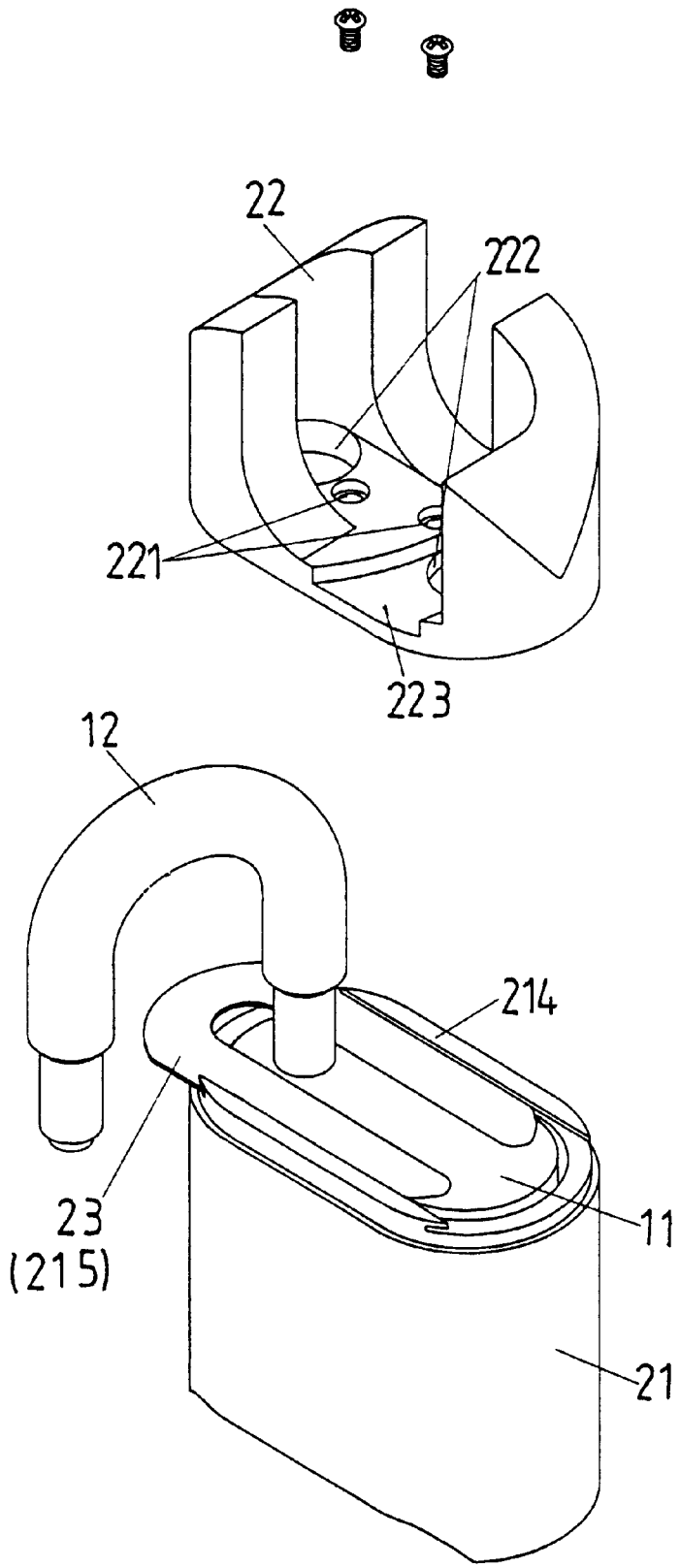
FIG. 3 shows the body of the lock is received in the first part of the protection case.
Figure 4:
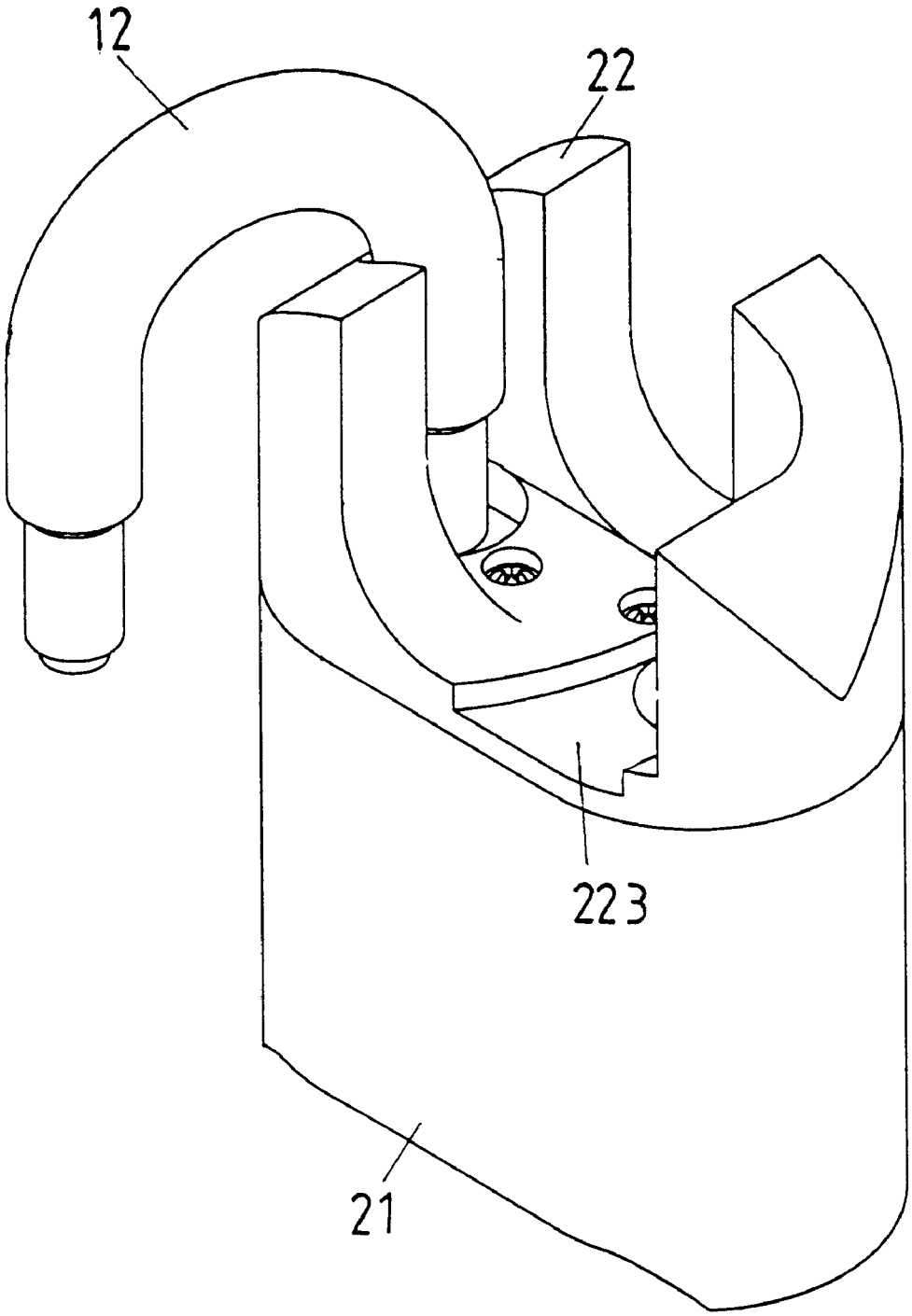
FIG. 4 is a perspective view to show the lock is protected by the protection case of the present invention.

Referring to FIGS. 1 to 4, the protection case of the present invention comprises a first part 21 and a second part 22, wherein the first part 21 has an open top 213 so as to receive the body 11 of the lock. An aperture. 216 is defined through a wall of the first part 21 and located in alignment with the key hole 112 in the body 11 of the lock. An opening 212 is defined through a bottom of the first part 21 so that the rings 111 with digits of the lock can be accessed via the opening 212. A shackle 12 is connected to a top of the body 11 and a locking hole 114 is defined in the top of the body 11. Two threaded holes 113 are defined in the top of the body 11 and located right in a projection of the shackle 12 between the locking hole 114 and the shackle 12 when the shackle 12 is in locked position.

A second part 22 includes a first hole 222 through which the shackle 12 extends, and a second hole 222 which is located in alignment with the locking hole 114. The second part 22 is securely mounted on the top of the body 11 by extending screws through holes 221 defined through the second part 22 and threadedly engaged with threaded holes 113 in the top of the body 11. A recessed area 223 is defined in a top of the second part 22 and communicates with the second hole 222 so as to allow the shackle 12 to rotate between locked position and unlocked position.

Two flanges 214 extend from a periphery of the open top 213 and each flange 214 includes a groove 215 defined in an inside thereof. A U-shaped retaining member 23 is slidably engaged with the grooves 215 so as to retain the body 11 in the first part 21.

The body 11 is then protected by the protection case and a foreign force cannot hit the body 11 directly. Besides, the rings 111 with digits are accessible from the bottom of the first part 21 so that when a correct key is inserted in the key hole 112 of the lock, the user may set his or her own set of digits.

Figure 5:
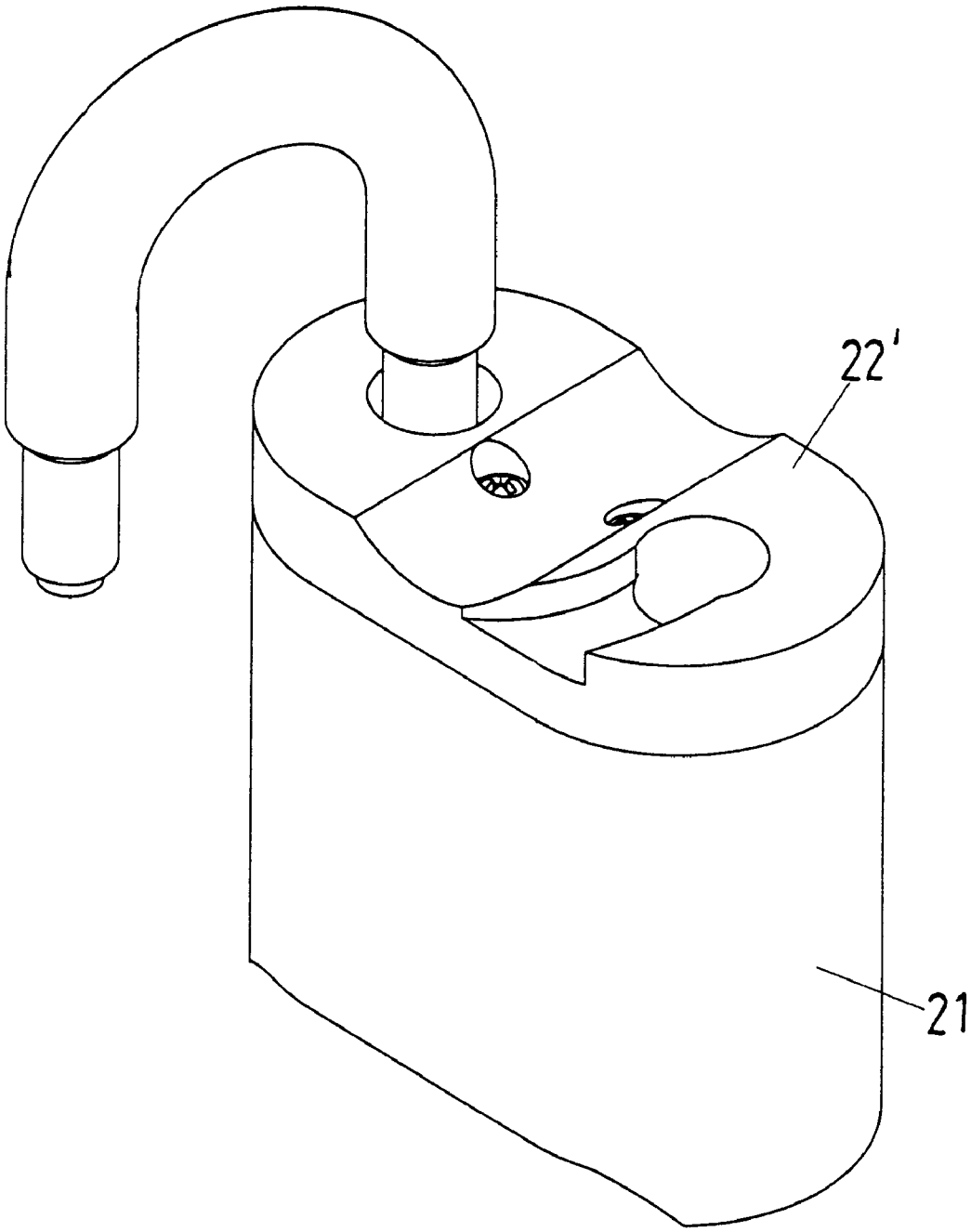
FIG. 5 shows another embodiment of the second part of the protection case.

FIG. 5 shows that the second part 22' can be an enclosed design.

While we have shown and described the embodiment in accordance with the present invention, it should be clear to those skilled in the art that further embodiments may be made without departing from the scope of the present invention.

What is claimed is:

1. A protection case for locks which has a body with a shackle connected to a top of the body and a locking hole defined in the top of the body, a key hole defined in a side of the body and a plurality of rings with digits located at a bottom of the body, the protection case comprising:

a first part having an open top so as to be adapted to receive the body in the first part, an aperture defined through a wall of the first part and adapted to be located in alignment with the key hole of the lock, an opening defined through a bottom of the first part so as to be adapted to enclose the rings of the lock, and a second part adapted to be securely mounted on the top of the body and includes a first hole which is adapted to allow the shackle to extend, and a second hole which is adapted to be located in alignment with the locking hole.

2. The protection case as claimed in claim 1, wherein two flanges extending from a periphery of the open top and each flange includes a groove, a U-shaped retaining member slidably engaged with the grooves.

3. The protection case as claimed in claim 1 further comprising two holes defined through the second part and adapted to be located beneath a projection of the shackle.

* * * * *